United States Patent [19]

Bon

[11] 4,389,004

[45] Jun. 21, 1983

[54] SELF-CLOSING TILTING VALVE

[76] Inventor: Luigi D. Bon, Feldstrasse 141, 4663 Aarburg, Switzerland

[21] Appl. No.: 284,221

[22] Filed: Jul. 17, 1981

[30] Foreign Application Priority Data

Aug. 5, 1980 [CH] Switzerland ..... 5911/80

[51] Int. Cl.[3] ..... B65D 83/14

[52] U.S. Cl. ..... 222/402.22; 222/402.12; 222/402.23; 251/354

[58] Field of Search ..... 222/402.1, 402.12, 402.21–402.24, 222/476, 501, 507, 513, 517, 528–529; 251/354; 137/614.11, 614.14; 239/574, 577, 573, 337

[56] References Cited

U.S. PATENT DOCUMENTS

| | | | |
|---|---|---|---|
| 2,662,669 | 12/1953 | Schmidt | 222/402.21 |
| 2,831,620 | 4/1958 | Schlicksupp | 222/517 |
| 3,406,944 | 10/1968 | Barker | 222/402.24 X |
| 3,450,316 | 6/1969 | Barker | 222/402.22 |
| 3,759,427 | 9/1973 | Stanley et al. | 222/402.23 |
| 3,920,165 | 11/1965 | Schultz | 222/402.23 |
| 4,008,834 | 2/1977 | Towns | 222/402.23 |

FOREIGN PATENT DOCUMENTS 928841 6/1963 United Kingdom .

*Primary Examiner*—Charles A. Marmor
*Attorney, Agent, or Firm*—Heinrich W. Herzfeld

[57] ABSTRACT

A self-closing tilting valve which is insertable in a valve mounting provided in the lid of a container filled with product under pressure, comprises a substantially rigid mandrel member having a base part and a tip part, and an enveloping member surrounding said mandrel member and having a foot part and a head part with an outlet opening. At least one passageway for product from the container leads along the mandrel member to the outlet opening, and at least one obturating face is provided on the inner wall of the enveloping member and a corresponding counter-face on the mandrel member in the region of said passageway, contact between said obturating face and said counter-face obturating said passageway in closed position. The tip part of said mandrel member and the head part of said enveloping member bear contact faces remaining in contact with each other during closed as well as during open position. One of the lower end parts of the two members embraces the lower end part of the other member, and one of the two members can be inserted in the mounting of the container lid. At least the head part and the foot part of the entire enveloping member consist of elastically flexible material which is deformable in radial as well as in axial direction with respect to a central longitudinal axis of the mandrel member. The head part of the enveloping member surrounds the tip part of the mandrel member and is snugly and sealingly fitted thereon in closed position.

12 Claims, 11 Drawing Figures

SELF-CLOSING TILTING VALVE

BACKGROUND OF THE INVENTION

This invention relates to a self-closing tilting valve which is sealingly insertable into a lid, provided with a valve mounting means, of a container filled with product under pressure, which valve comprises a central mandrel member having a base part and a tip part and an enveloping member having a head part containing an outlet opening and a foot part, at least one passageway for product being provided extending along the mandrel member from the container to the said outlet opening, and at least one sealing surface being provided at the interior wall of the enveloping member which sealing surface obturates the product passage when in closing position, by sealingly engaging a corresponding counter-surface of the mandrel member, which counter-surface is located within the range of the passageway, the tip part of the mandrel member being in contact with the surrounding head part of the enveloping member in closed as well as in open position, while one of the foot part and the base part is insertable in the valve mounting of the container lid.

A valve of this kind has been described in U.S. Pat. No. 2,831,620 to T. F. Schlicksupp. However, this kind of valve is not suitable for use with pressurized product-filled containers, in particular, when the internal excess pressure in the container reaches the usual values of, for instance, 3 to 5 bar. Such excess pressures would cause an expansion and/or lateral displacement of the bellow-type central zone provided in the enveloping member of Schlicksupp's valve and thus cause it to open unintentionally.

Valves of the Schlicksupp-type are, therefore, only used for liquids such as toilet water, skin lotions, perfumes and also for creams which are present in the container under no or much less excess pressure.

Another tilting valve of somewhat similar construction has been described in U.S. Pat. No. 3,920,165 to Robert S. Schultz. This valve would indeed be suitable for containers having contents under higher internal pressure. However, in this valve which contains, beside a mandrel member, an internal enveloping member and an external cap member, the tip part of the mandrel member does not remain in contact with the inner wall of the head part of the cap member when the valve is opened. Rather, a spacing apart occurs between both parts, while in the case of the tilting valve according to the invention as well as in the case of Schlicksupp's valve, these two parts should remain in contact with one another in the closed as well as in the opened position. A spacing apart between the two tiltably supported members of the Schultz valve jeopardizes a resealing of the valve after each opening stage, even when the dimensioning of the cap member and the internal enveloping member with respect to each other is very exact, because of the variable support means of the two members. For, the cap member must find support simultaneously on the container lid wall and against a shoulder provided in the sidewall of the enveloping member, which latter must in turn provide support for the mandrel member.

OBJECTS AND SUMMARY OF THE INVENTION

In view of the foregoing, it is a main object of the invention to provide a self-closing tilting valve which affords a satisfactory double sealing effect, i.e. a sealing at two places in the valve, and an unobjectionable opening and closing of the valve while requiring at the same time a minimum of valve parts, and the simplest possible manner of assembling the valve.

This object and others which will become apparent in the following description, are attained in a tilting valve of the initially described type which possesses the following characterizing features in accordance with the present invention, namely that at least the head part and the foot part of the enveloping member consist of an elastically flexible, resilient material which is deformable in axial as well as radial direction, with regard to the central longitudinal axis of the mandrel member, while, at the same time, the head part of the enveloping member surrounds the tip part of the mandrel member, fitting snugly onto the latter in sealing engagement.

In a preferred embodiment of the tilting valve according to the invention, a sealing surface for obturating the product passageway is provided at the foot part of the enveloping member and engages, in closed position, a corresponding wall of the mandrel member base part, which wall delimits the said passageway; preferably in the foot part or base part of one of the two members, there is provided a collar element embracing the base or foot part of the other member, which collar element preferably has an annular flange which is crimped at least approximately radially inwardly underneath the base or foot part of the other member. This flange thus biases the base or foot part of the other member axially upwardly and thereby urges the counter-surface of the last-mentioned part with hermetical sealing effect onto the sealing surface of the member provided with the collar element and obturates the product passageway; while, in open or discharge position the enveloping member, on the one hand, as well as the mandrel member on the other hand, are tilted about a tilting axis extending in a plane transverse to the longitudinal central axis and located at the level of the mandrel member base part or slightly above the latter.

In this case, it is of particular advantage to devise the valve of such configuration that the base part of the mandrel member embraces, by means of a collar element projecting from that base part upwardly (i.e. in a direction away from the container on which the valve is to be mounted), the foot part of the enveloping member and reaches with its annular flange portion above the latter, overlapping the peripheral zone of the upper side of the foot part, thereby exerting a pressure which is directed axially inwardly, with regard to the above-mentioned container, on an annular outwardly projecting bead portion of the said foot part.

In this case, the tip part of the mandrel member can be outwardly conically tapered, and the head part of the enveloping member can have a correspondingly beveled face in its inner wall surface surrounding the outlet opening.

It is also especially advantageous to so construct the tilting valve according to the invention, that the foot part of the enveloping member embraces the base part of the mandrel member by means of a collar part projecting from the foot part inwardly, i.e. in the direction toward the interior of the container, and that the annular flange of the collar part grips the base part of the mandrel member from below, thus exerting on the underside of the mandrel member base part a pressure directed outwardly, i.e. away from the container interior.

Moreover, the enveloping member can have, especially in this case wherein its foot part bears the said collar element, an annular recess in its external wall at a level adjacent said foot part, which recess is engaged by mounting means provided in the container lid. Furthermore, in the same embodiment, the base part of the mandrel member can have in its periphery underneath which the crimped annular flange of the foot part of the other member extends, one or several recesses facilitating the passage of product between its peripheral sidewall and the internal wall of the foot part collar element of the enveloping member.

It is also possible for at least one duct or passage to extend from the underside to the upper side of the base part of the mandrel member, and an annular projection having a downwardly directed blade-like edge or rim can protrude from the inner side, of the foot part of the enveloping member, which faces toward the upper side of the base part of the mandrel element; this annular projection will engage the upper side of the mandrel element base part in the closing position, so as to obturate the orifices, in that upper side, of the passages or ducts through the said base part.

According to a further preferred feature of the invention, the lateral wall of the tip part of the mandrel member can have a conical outwardly broadening tapering, i.e. with the cone apex toward the container interior, and the head part of the enveloping member can have a corresponding conical bevel about the outlet opening which bevel is flared toward the outside, in the inner wall of the enveloping member surrounding the outlet opening. Moreover, in the inner peripheral zone of the beveled wall portion of one of the two members there can be provided at least one projection which extends radially toward the corresponding zone of the other member, thus ensuring formation of a gap between the two beveled wall portions when the valve is being opened.

In a further embodiment of the tilting valve according to the invention, the base part of the mandrel member can extend downwardly, i.e. toward the container interior, beyond the underside of the foot part of the enveloping member and can have a broadened head having an annular shoulder facing toward the said foot part underside and being in sealing contact with the latter when the valve is in closed position.

The above-described features and embodiments of the tilting valve according to the invention allow a particularly uncomplicated and, therefore, cost-saving manufacture of the valve parts, with easy removal of molds and cores in the case of injection molding, and an easy assembly of the valve.

The construction of the valve is simplified particularly by the fact that the functions which must be carried out by a plurality of elements in the hitherto known valves, are now fulfilled by a minimum number of elements, namely two, in the valve according to the invention. The satisfactory obturation of product passages in the closed valve is guaranteed by elements exerting positive sealing pressure. At the same time, the double sealing effect namely between the tip part and the head part, on the one hand, and the base part and the foot part, on the other hand, of the mandrel element and the enveloping element, is effected in a most simple manner requiring no high-precision dimensioning of the elements and nevertheless satisfying all requirements for a satisfactory sealing even when the product in the container is at a pressure of from 3 to 5 bar above ambient pressure.

The preferred embodiments of the tilting valve according to the invention also permit a very simple filling of product into the container by way of the valve after mounting of the same in the container, without requiring the tilting of the mandrel member and or the enveloping member. This is not possible in the case of the known valves described hereinbefore.

BRIEF DESCRIPTION OF THE DRAWINGS

Further details of the invention will become apparent from the following description thereof in connection with the accompanying drawings in which.

DETAILED DESCRIPTION OF THE EMBODIMENTS SHOWN IN THE DRAWINGS

Figure 1:
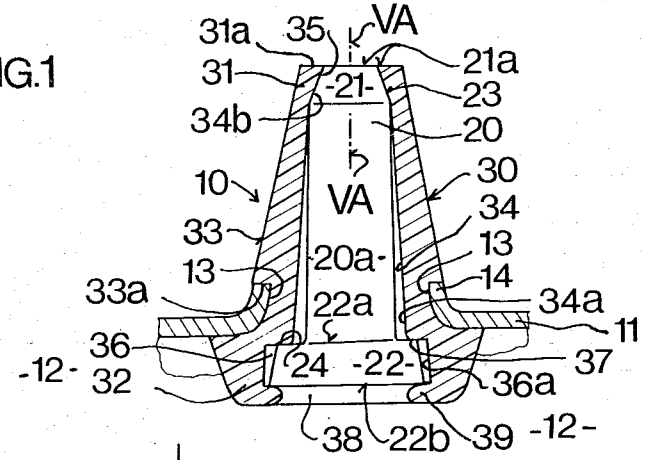
FIG. 1 is a longitudinal sectional view of a first embodiment of the tilting valve according to the invention, with the parts in closed position.
Figure 2:
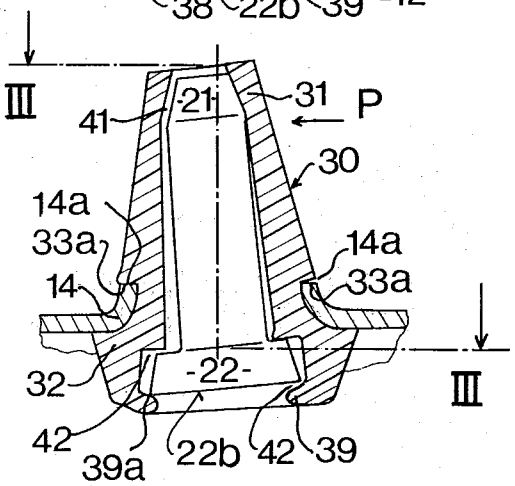
FIG. 2 shows the same section as FIG. 1, but with the parts in open position.

The embodiment 10 of the tilting valve according to the invention, as shown in FIGS. 1 and 2 is mounted in the lid 11 of a container (not shown) which holds a liquid product 12 under pressure; the valve 10 closes an outlet orifice 13 provided in the lid 11 which orifice 13 is surrounded by a socket part 14 projecting outwardly, i.e. away from the container interior.

The valve 10 comprises a mandrel member 20 having a tip part 21, a base part 22 and a shaft or stem part **20*a*** connecting the aforesaid two parts.

The lateral wall 23 of the tip part 21 is beveled, preferably conically, with its cross-section narrowing outwardly toward a frontal end face **21*a* of the tip part 21**.

The base part 22 is of larger diameter than the stem part **20*a*, thus providing an annular shoulder 22*a*, a peripheral zone 24 of which can serve as one of the sealing faces of the valve 10. The base part 22 is preferably of frustoconical or cylindrical configuration, having thus a bottom face or underside 22*b* of a larger or of the same diameter as the upper side or shoulder 22*a***.

The valve 10 further comprises an enveloping member 30 having a head part 31 and a foot part 32 which are connected with each other by a middle wall portion which is preferably of generally frusto-conical configuration and preferably has a conically tapered external wall surface 33.

The enveloping member has a central axial passageway or bore 34 which opens in the top end face 31*a* of head part 31 through an outlet opening 35, while, toward the container interior, the passageway 34 opens into a chamber 36 which is preferably of cylindrical configuration and whose diameter in a direction radial to the valve axis is preferably larger than the internal width of the opening 34*a* of passageway 34 in the upper wall of the chamber 36. Thereby, a shoulder 37 is formed in the latter wall about the said orifice 34*a*, which shoulder serves as a counter surface to the sealing surface 24 of the mandrel member base part 22.

The chamber 36 is open toward the container interior and is provided about its bottom opening 38 with an elastically resilient, somewhat deformable annular flange 39 projecting into that opening. By providing the chamber sidewall 36*a* of a dimension in axial direction which is slightly shorter than the corresponding axial height of the mandrel member base part 22, the annular flange 39 is slightly bent downwardly, when the said base part 22 is inserted into the chamber 36, and thus urges the sealing surface 24 of the base part 22 positively against the counter-surface (shoulder) 37 in the enveloping member 30. Simultaneously, the lateral wall 23 of the mandrel member tip part is urged against the correspondingly conically tapered head part zone 34*b* of the passageway 34, the elastic deformability of the material of the enveloping member permitting a relatively large tolerance in dimensioning the distance between the annular shoulder 37 and the beveled head part surface 34*b*.

When a lateral pressure P is applied to the enveloping member 30 (FIG. 2), then, due to the pressure exerted by its head part 31 onto the tip part 21 of the mandrel member 20, the latter is also being tilted, whereby the edge of bottom face 22*b* remains supported on the arcuate reach 39*a* on the annular flange 39 which latter is shifted, however, due to the tilting of the enveloping member 30, slightly toward the right in FIG. 2. During tilting of the enveloping member 30, an annular shoulder 33*a* in the external wall surface 33 of the same finds support on the annular rim face 14*a* of the socket part 14 on the side of the latter opposite to that side of the enveloping member 30 to which the pressure P is applied. The mandrel member 20 and the enveloping member 30 are thus tilted about tilting axes which are located in a zone designated by DA in FIG. 2.

Figure 3:
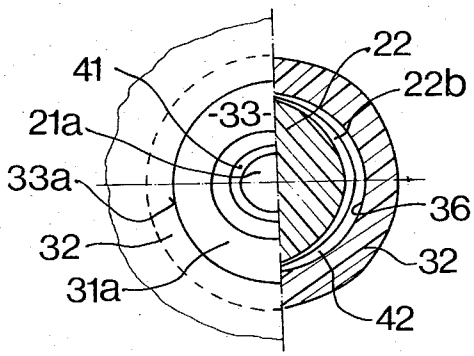
FIG. 3 is a cross-sectional view of the embodiment shown in FIG. 2 with the parts in open position, and taken in planes indicated by III—III in FIG. 2.

As can be seen from FIGS. 2 and 3, this tilting causes the formation of gaps designated by 41 and 42, between base part 22 and foot part 32, on the one hand, and between tip part 21 and head part 31, on the other hand.

Figure 4:
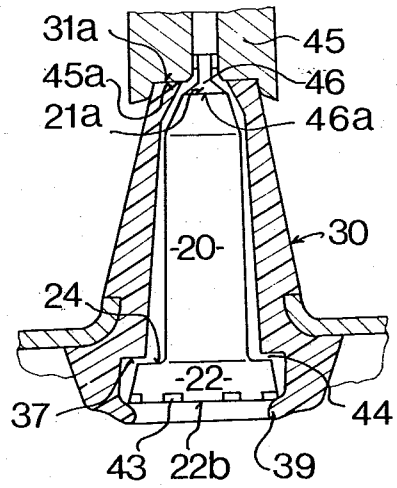
FIG. 4 is an axial sectional view of an embodiment similar to that shown in FIGS. 1 to 3, with the socket of a product-filling apparatus mounted on top of the valve.

In FIG. 4, there is shown a similar valve which is provided with product passage grooves or recesses 43 about the periphery of the bottom surface 22*b* of base part 22. FIG. 4 also illustrates the filling of a container through the valve by means of a filling socket 45 having a downwardly displaceable nose 46.

The socket 45 is placed with its frontal face 45*a* onto the frontal upper face 31*a* of the enveloping member 30, while the frontal face 46*a* of the nose 46 is seated on the upper frontal face 21*a* of the mandrel member tip part 21. By advancing the nose 46 vertically downwardly, the mandrel member 20 is displaced downwardly, whereby the edge of the bottom surface 22*b* slightly deflects the annular flange 39 of the enveloping member 30 downwardly and outwardly, thus opening between the faces 24 and 37 an annular gap 44 through which product can be forced into the hollow annular space between the two members and through the recesses 43 in the bottom edge of base part 22 into the container interior.

Figure 7:
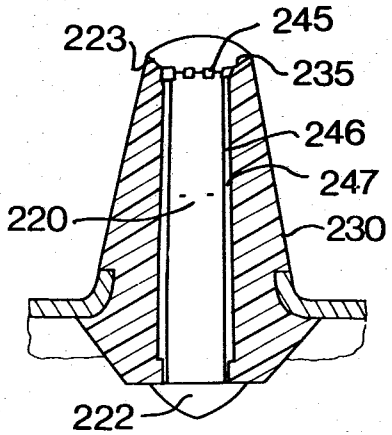
FIG. 7 shows yet another embodiment in axial sectional view and in closed position.
Figure 8:
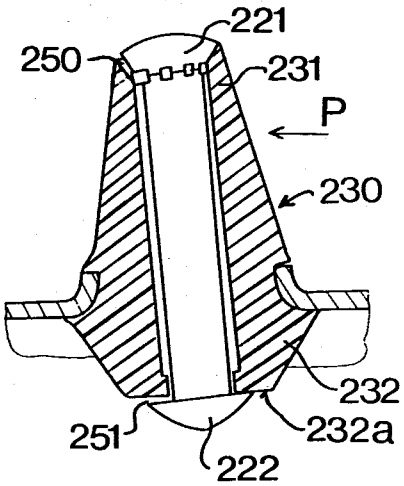
FIG. 8 is a similar view through the same embodiment as shown in FIG. 7, but in open position.

The embodiment of a tilting valve according to FIGS. 7 and 8 is distinguished from the two preceding embodiments, for example, by the fact that the contact surfaces 223 and 235 constitute frustoconical mantle faces which do not narrow in outward direction along the valve axis but rather, invertedly, whose cone apex is located on this axis inwardly, with the cone base located toward the outside; distancing projections 245 are provided in this embodiment about the periphery of the smaller, inwardly located frustocone end face. These spacing projections 245 protrude at the upper end of the cylindrical wall 246 of the mandrel member from the latter into the free space 247 between the mandrel member 220 and the enveloping member 230.

When tilting the valve, the enveloping member 230 and the mandrel member 220 are tilted with displacement of the tip or head parts 221 and 231 relative to one another. Thereby, when the projections 245 are mounted at the lower end of the mandrel member tip part 221, the conical surface 231 comes into contact with one or several of the projections 245 and is thereby lifted off the opposite conical contact face 223, thus forming a gap 250.

At the same time, a gap 251 is formed between the base part 222 of the mandrel member 220 and the underside 232*a* of the foot part 232 of the enveloping member 230. This permits product to emerge from the valve via the gap 251, the passageway 247 and the gap 250, e.g. as a foam.

Figure 5:
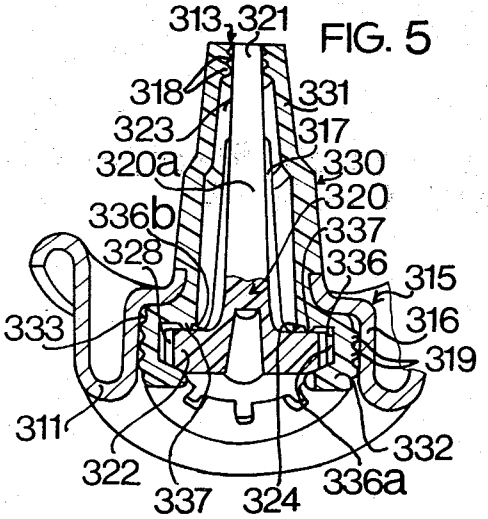
FIG. 5 is an axial view of a further embodiment of the tilting valve according to the invention, with the parts in closed position.

The embodiment shown in FIG. 5 is similar to that of FIGS. 1 and 2. However, the base part 322 of the mandrel member 320 is provided at its circumferential sidewall 325 with a plurality of preferably wedge-shaped axially extending ribs 328 which project radially into corresponding recesses 327 in the internal sidewall 336*a* of chamber 336 in the foot part 332 of enveloping member 330.

In its external sidewall 333, the foot part 232 bears a plurality of annular ribs 319 which sealingly engage the inner surface of an axially extending peripheral sidewall 316 of a dome part 315 which projects outwardly from the lid 311 of a container (not shown) which the lid 311 is to close. The shaft 320*a* of the lid bears on its outside axial reinforcing ribs 317.

In lieu of the conically tapered contact faces engaging one another at the tip part of the mandrel member and the head part of the enveloping member of the preceding embodiments, the inner wall surrounding the valve cutlet opening 313 in the head part 331 of the enveloping member 330 bears a plurality of inwardly projecting ribs 318 which sealingly engage the external wall 323 of the mandrel member tip part 321.

Instead of the contact faces between the upper base part surface 24 of the mandrel member and the annular shoulder 37 of the enveloping member in the embodiments of FIGS. 1 and 2, the embodiment of FIG. 5 provides for an annular rib 337 projecting downwardly from the upper roof wall 336*b* of foot part chamber 336 and abuts in sealing contact with the annular upper surface 324 of the base part 322 of mandrel member 323.

The provision of wedge-shaped axial ribs on the circumference of the mandrel member base part, and of corresponding recesses in the chamber sidewall of the enveloping member increase the contact faces and thereby improve guidance of the two members during their relative movements during opening and closing of the valve.

The axial ribs provided on the shaft portion of the mandrel member stiffen the latter and ensure that there is but a small delay between the opening of a gap between the top ends of the two members and the opening of a pasage of product past the annular sealing rib 337. When a longer delay between the two opening steps is desired, then a more flexible shaft portion of the mandrel member can be provided by shortening or completely omitting the ribs.

A riser tube can be mounted firmly and sealingly in a recess in the underside of the mandrel member base part. This simple manner of mounting the riser tube avoids the use of complicated machinery.

Figure 6:
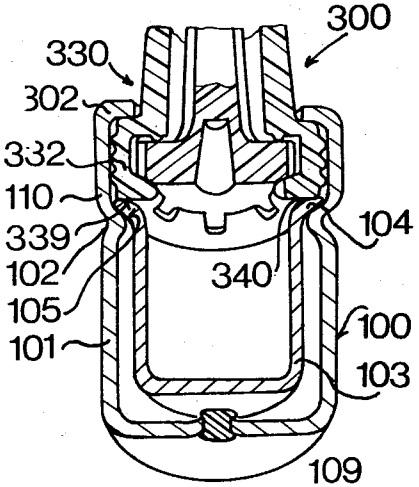
FIG. 6 is an axial sectional view through the same embodiment as shown in FIG. 5, but with the parts in open position.
Figures 9, 10, 11:
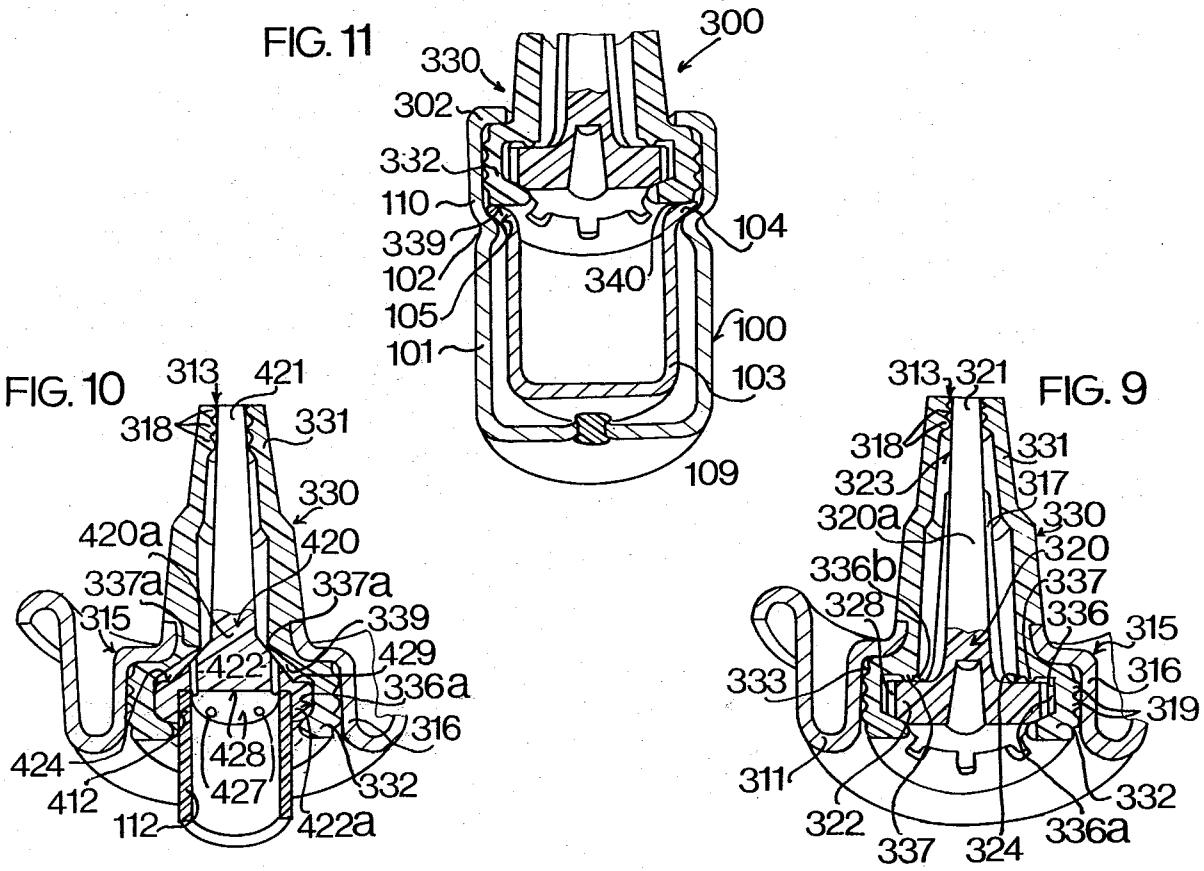
FIG. 9 is a perspective view, with the parts shown partially in axial section, of a further embodiment.
FIG. 10 is a similar view as in FIG. 9, but with a riser tube connected to the base part of the mandrel member.
FIG. 11 shows in perspective and partially in section, a container equipped with a tilting valve according to the invention.

In the embodiment of FIG. 5, the valve can also be actuated to open by axial depression of the mandrel member 320 be conical and adapted to establish contact snugly with the corresponding beveled wall zone 429 on the upper side Finally, FIG. 6 shows the manner in which a valve 300 having the embodiment of FIG. 5 can be mounted on a container 100 the lid part 110 of which is integral with the outer container mantle 101. The foot part 332 of enveloping member 330 is seized between the annular indentation engaging the valve foot part 332 at its underside 339, and the inwardly crimped upper annular end flange 102 of lid part 110.

Preferably, the container 100 contains a compressible product-containing bag 103 which is open at the top, while the bag rim portion 104 is clamped in between the underside 339 of the enveloping member foot part 332 and the upper annular side 105 of the indentation 102. An annular sealing lip 340 can depend from the underside 339 of foot part 332 and be urged with bias against the inner upper end zone of the bag 103.

The interspace between mantle 101 and bag 103 can be filled via a check valve 109 with a propellant under pressure which increasingly compresses bag 103 as product is discharged from the latter.

As preferred materials for the enveloping part of the valve there are recommended polyester elastomers such as, in particular, the product commercially available under the name of Hytrel ® (see Publication A.82197-4 of du Pont de Nemours (Deutschland) G.m.b.H., Düsseldorf, Germany.

Through the valve according to the invention there can be discharged such products as cosmetics, pharmaceuticals, cleansing agents, or foodstuffs. As propellants there can be used all those whose use is permitted in conventional aerosol spray cans.

The terms "upward", "downward", "upper side", "lower side" or "underside" and similar terminology refer to positions of the respective parts as shown in the accompanying drawings, while "inner", "outer", "axially inward" and "axially outward" refer to the positioning of parts of the tilting valve according to the invention with respect to the container on which the valve is to be mounted. The foot part and the base part of, respectively, the enveloping and the mandrel member are also referred to as the lower end parts of these members, while the head part and the tip part of these members are also referred to as their upper end parts.

What is claimed is:

1. Self-closing tilting valve sealingly insertable in a lid for a container fillable with product under excess pressure and provided with a valve mounting, which valve comprises an essentially rigid mandrel member having a base part and a tip part, an enveloping nozzle member surrounding said mandrel member and having an axial product passage surrounded by an inner wall and receiving said mandrel member therein, a head part with an outlet opening for said axial passageway, a foot part having a bottom opening for said axial passageway, and an intermediate portion extending axially between said head part and said foot part, said foot part of said nozzle member having a cavity therein opening at the underside of said foot part, said base part of said mandrel member being lodged in said cavity, and extending therein transversely to the central longitudinal axis of said mandrel member, said passageway being obturated, in closed valve position, by sealing contact between an obturating surface of said inner wall in said cavity and a correspondingly located counterface on said base part of said mandrel member, and being further obturated by said head part of said nozzle member surrounding said tip part of said mandrel member snugly laterally when said valve is in closed position, an upper portion of said foot part of said nozzle member up to its merging zone with said intermediate portion being insertable in the said valve mounting, said tip part of said mandrel member and said head part of said nozzle member remaining in contact with one another in the closed as well as in any discharge position, a radially inwardly projecting annular flange of said foot part on the underside of the latter which flange engages with upward bias the underside of the base part of said mandrel member, and urges said obturating face and said counterface into sealing engagement with one another, which valve is characterized by the following inventive combination of features:

(a) said annular flange consists of an elastically flexible material which is deformable downwardly in axial as well as radial direction in respect of the longitudinal central axis of said mandrel member, while the upper portion of said foot part and the intermediate portion of said nozzle member are substantially rigid, and (b) space for radial play being provided about the lateral peripheral wall of said mandrel member base part, permitting radial displacement of said base part within said cavity during tilting of the intermediate portion and the head part of said nozzle member, and corresponding tilting of said mandrel member, said space for radial play constituting part of said passageway and being obturated in closed position by said annular flange, while being opened, by tilting pressure being applied to the portion of said nozzle member above said foot part and simultaneously to said mandrel member.

2. Tilting valve according to claim 1, wherein (c) the diameter of said passageway in said head part of said nozzle member adjacent said outlet opening widens in the direction toward said foot part thereof, and, upon tilting pressure being applied, said tip part of said mandrel member is withdrawn inwardly into said passageway due to axial downward displacement of the said member, thereby freeing said outlet opening.

3. Tilting valve according to claim 1, wherein said passageway is opened, when tilting pressure is applied, by the underside of said base part being lifted upwardly in said cavity and off the underlying zone of said annular flange, and the upper face of said base part rests against the top wall of said cavity, on the side of applied tilting pressure, while the said flange is deflected downwardly by said base part on the opposite side of the latter, and, on that opposite side, said upper face of said base part is moved downwardly out of contact with the obturating face in said nozzle member cavity, thus opening free communication from the underside of said foot part through said space of radial play to the remainder of said passageway.

4. Tilting member according to claim 1, wherein said nozzle member comprises, in a zone in which said intermediate portion thereof is joined to said foot part, a transverse zone of reduced diameter adapted to be engaged by said valve mounting, thereby causing said intermediate portion to lift off, on the side thereof to which tilting pressure is applied, from said valve mounting.

5. Tilting member according to claim 1, wherein the portion of said passageway extending from said upper face of said base part to said tip portion along said mandrel member is free from obturation during closed as well as during discharge position.

6. Tilting valve according to claim 1, wherein the tip part of said mandrel member bears a conically tapered sidewall of axially outwardly narrowing diameter, and wherein the head part of said nozzle member surrounding said tip part has an inner end wall about said outlet opening which inner end wall is correspondingly tapered to sealingly contact said tip part sidewall in closed position.

7. Tilting valve according to claim 1, wherein said base part of said mandrel member bears in the region of its underside contacted by said radially inwardly projecting flange at least one axial groove opening into said space of radial play, for the passage of product therethrough.

8. Tilting valve according to claim 7, wherein said base part of said mandrel member has in its circumferential external sidewall at least two axially extending ribs and a groove therebetween.

9. Tilting valve according to claim 8, wherein said foot part of said nozzle member has in the inner circumferential sidewall of its cavity facing said circumferential external sidewall of said base part, at least two axial grooves into which said axially extending ribs of said base part sidewall project.

10. Tilting valve according to claim 4, wherein said nozzle member has, in an outer sidewall surface above said foot part thereof, an annular shoulder facing axially downward and being adapted for abutting against said container lid mounting, said shoulder being located in said outer sidewall.

11. Tilting valve according to claim 3, wherein the upper annular flange face of said annular flange, adapted for engagement with the underside of said base part, is downwardly inwardly tapered toward said bottom opening for sliding downward displacement of the rim portion of the base part underside remaining in contact during tilting with said upper annular flange face on the side away from tilting pressure (leeward side).

12. Tilting valve according to claim 1, wherein said annular flange has a plurality of radial slits in the portion thereof about said bottom opening.

* * * * *